US006332438B1

(12) United States Patent
Machida

(10) Patent No.: US 6,332,438 B1
(45) Date of Patent: Dec. 25, 2001

(54) VANE-TYPE VARIABLE VALVE TIMING CONTROL APPARATUS AND CONTROL METHOD

(75) Inventor: Kenichi Machida, Atsugi (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 0 days.

(21) Appl. No.: 09/678,810

(22) Filed: Oct. 4, 2000

(30) Foreign Application Priority Data

Oct. 7, 1999 (JP) ..... 11-286782

(51) Int. Cl.[7] ..... F01L 1/34

(52) U.S. Cl. ..... 123/90.15; 123/90.17; 123/90.12; 123/90.31

(58) Field of Search ..... 123/90.15, 90.16, 123/90.17, 90.18, 90.31, 90.12, 90.34, 90.38; 74/567

(56) References Cited

U.S. PATENT DOCUMENTS 5,184,578 * 2/1993 Quinn, Jr. et al. ..... 123/90.17
5,218,935 * 6/1993 Quinn, Jr. et al. ..... 123/90.17
5,289,805 * 3/1994 Quinn, Jr. et al. ..... 123/90.17
5,836,277 * 11/1998 Kira et al. ..... 123/90.17
6,006,708 * 12/1999 Ken et al. ..... 123/90.17
6,129,060 * 10/2000 Koda ..... 123/90.17
6,129,062 * 10/2000 Koda ..... 123/90.17
6,135,077 * 10/2000 Moriya et al. ..... 123/90.17
6,186,104 * 2/2001 Torii et al. ..... 123/90.17
6,202,610 * 3/2001 Yoshiki et al. ..... 123/90.15
6,216,655 * 4/2001 Yoshiki et al. ..... 123/90.15
6,230,675 * 5/2001 Kobayashi et al. ..... 123/90.15
6,250,265 * 6/2001 Simpson ..... 123/90.17
6,260,526 * 7/2001 Kobayashi ..... 123/90.17

FOREIGN PATENT DOCUMENTS 10-68306 3/1998 (JP) .
10-141022 5/1998 (JP) .

* cited by examiner

*Primary Examiner*—Teresa Walberg
*Assistant Examiner*—Fadi H. Dahbour
(74) *Attorney, Agent, or Firm*—McDermott, Will & Emery

(57) ABSTRACT

A vane-type variable valve timing control apparatus, wherein in a feedback control for bringing a rotation phase between a crank shaft and a cam shaft into agreement with a target value, a feedback gain is changed over according to a target rotation phase and a direction in which the rotation phase is changed.

10 Claims, 4 Drawing Sheets

VANE-TYPE VARIABLE VALVE TIMING CONTROL APPARATUS AND CONTROL METHOD

BACKGROUND OF THE INVENTION

1. Field of the Invention

The present invention relates to a vane-type valve timing control apparatus and control method for an internal combustion engine. More specifically, the invention relates to a vane-type valve timing control apparatus having a resilient member for urging the vanes secured to the cam shaft toward the advance angle side or the delay angle side, and control method.

2. Related Art of the Invention

As a vane type variable valve timing control apparatus, there is one heretofore disclosed in Japanese Unexamined Patent Publication Nos. 10-141022 and 10-068306.

With this apparatus, recess portions are formed on an inner peripheral face of a cylindrical housing secured to a cam sprocket, while vanes secured to a cam shaft are accommodated in the recess portions, the construction being such that the cam shaft can rotate relatively with respect to the cam sprocket, within a range in which the vanes can move inside the recess portions.

Furthermore, the construction is such that by supplying and discharging oil by means of a spool valve, relatively with respect to a pair of hydraulic chambers (advance angle side hydraulic chamber and delay angle side hydraulic chamber) formed by the vanes partitioning the recess portions into front and rear in the rotation direction, the position of the vanes in the recess portions is changed, thereby enabling a rotation phase of the cam shaft relative to a crank shaft to be continuously changed.

A control value of the spool valve is determined by adding a feedback correction value set depending on a deviation of an actual rotation phase from a target value, to a constant neutral control value (basic control value) for retaining a rotation phase. A dither signal is then superimposed on the determined control value which is then output to an actuator of the spool valve.

However, as disclosed in Japanese Unexamined Patent Publication No. 10-068306, in the case where a resilient body such as a spiral spring for urging the vane to the advance angle side or to the delay angle side is provided, the urging force of the resilient body varies due to the rotation phase. Therefore, the response characteristic in the feedback correction of the rotation phase varies depending on the rotation phase and the direction of change thereof, causing a delay in the response to a particular change in the rotation phase.

SUMMARY OF THE INVENTION

In view of the above problems, it is an object of the present invention, with a vane type variable valve timing control apparatus comprising a resilient body for urging a vane to an advance angle side or to a delay angle side with respect to a cam sprocket, to enable a feedback control to be executed with an equivalent response characteristic for each rotation phase and to enable a target rotation phase to be precisely maintained without a response delay.

In order to accomplish the above-mentioned object, according to the present invention, a gain in a feedback control for bringing the rotation phase into agreement with a target is changed over according to a target rotation phase.

According to this constitution, the gain in the feedback control is changed over according to the urging force of the resilient member that differs depending on the rotation phase, thereby preventing the occurrence of a delay in the response at a particular rotation phase, to accomplish a target rotation phase by the feedback control while maintaining a high response characteristic at all times.

Further, the constitution may be such that the gain in the feedback control for bringing the rotation phase into agreement with the target, is changed over according to a direction in which the rotation phase is changed.

According to this constitution, the gain in the feedback control is changed over according to a change in the urging force of the resilient member caused by the direction in which the rotation phase is changed, thereby preventing the occurrence of a delay in the response due to the direction in which the rotation phase is changed, to accomplish a target rotation phase by the feedback control while maintaining a high response characteristics at all times.

Further, the constitution may be such that the gain in the feedback control for bringing the rotation phase into agreement with the target, is changed over according to the target rotation phase and the direction in which the rotation phase is changed.

According to this constitution, the gain in the feedback control is changed over according to the urging force of the resilient member that differs depending on a change in the rotation phase and according to a change in the urging force of the resilient member that differs depending on the direction in which the rotation phase is changed, thereby preventing the occurrence of a delay in the response at a particular rotation phase or a delay in the response due to the direction in which the rotation phase is changed, to accomplish a target rotation phase by the feedback control while maintaining a high response characteristic at all times.

The other objects and features of the present invention will become obvious from the following description of the related embodiment in connection with the accompanying drawings.

DESCRIPTION OF THE PREFERRED EMBODIMENT

Figure 1:
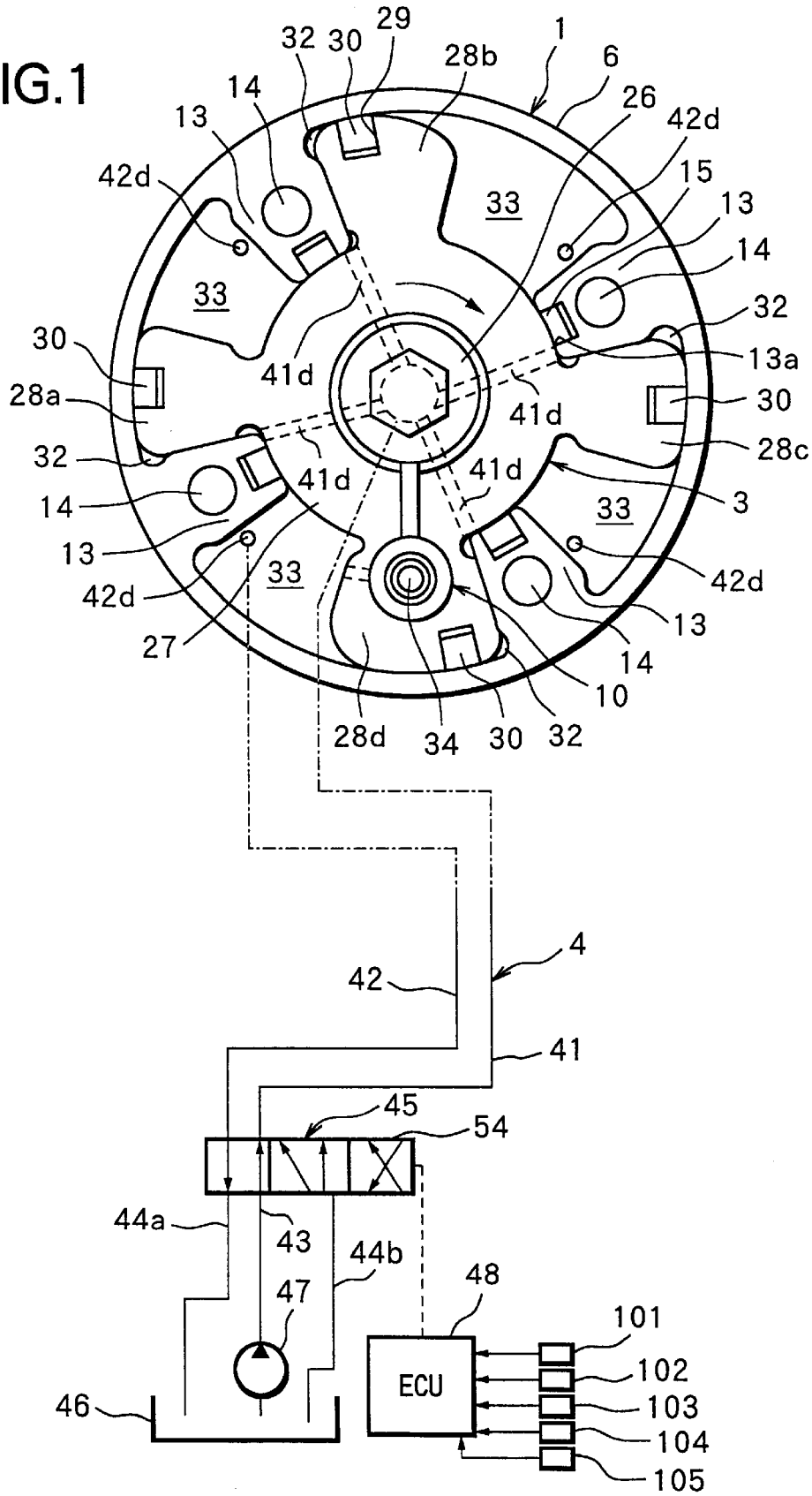
FIG. 1 is a sectional view showing a structural portion of a valve timing control apparatus in one embodiment.

FIG. 1 shows a structural portion of a vane type variable valve timing control apparatus of an internal combustion engine, in an embodiment. In an engine comprising both a cam shaft on the intake side and a cam shaft on the exhaust side, this apparatus is applied to the cam shaft on the intake valve side, to variably control the valve timing of an intake valve.

The vane type variable valve timing control apparatus shown in FIG. 1 comprises: a cam sprocket 1 (timing sprocket) which is rotatably driven by an engine crank shaft (not shown in the figure) via a timing chain; a rotation member 3 secured to an end portion of a cam shaft and rotatably housed inside the cam sprocket 1; a hydraulic circuit 4 for relatively rotating the rotation member 3 with respect to the cam sprocket 1; and a lock mechanism 10 for selectively locking a relative rotation position between the cam sprocket 1 and the rotation member 3 at a predetermined position.

The cam sprocket 1 comprises: a rotation portion (not shown) having on an outer periphery thereof, teeth for engaging with a timing chain (or timing belt); a housing 6 located forward of the rotation portion, for rotatably housing the rotation member 3; and a front cover and a rear cover (both not shown) for closing the front and rear openings of the housing 6.

Furthermore, the housing 6 presents a cylindrical shape formed with both front and rear ends open and with four partition portions 13 protrudingly provided at positions on the inner peripheral face at 90° in the circumferential direction. The partition portions 13 present a trapezoidal shape in transverse section, and are respectively provided along the axial direction of the housing 6. Each of the opposite end edges are in the same plane as the opposite end edges of the housing 6, and on the base edge side are formed four bolt through holes 14 in the axial direction, through which bolts are inserted for axially and integrally coupling the rotation portion, the housing 6, the front cover and the rear cover. Moreover, inside of retention grooves 13*a* formed as cut-outs along the axial direction in central locations on the inner edge faces of each partition 13 are engagingly retained seal members 15.

The rotation member 3 is secured to the front end portion of the cam shaft by means of a fixing bolt 26, and comprises an annular base portion 27 having, in a central portion, a bolt hole through which the fixing bolt 26 is inserted, and four vanes 28*a*, 28*b*, 28*c*, and 28*d* integrally provided on an outer peripheral face of the base portion 27 at 90° locations in the circumferential direction.

The first through fourth vanes 28*a* to 28*d* present respective cross-sections of approximate trapezoidal shapes. The vanes are disposed in the recess portions between each partition portion 13 so as to form spaces in the recess portions to the front and rear in the rotation direction. Advance angle side hydraulic chambers 32 and delay angle side hydraulic chambers 33 are thus formed between the opposite sides of the vanes 28*a* to 28*d* and the opposite side faces of the respective partition portions 13.

Inside of respective retention grooves 29 notched axially in the center of the outer peripheral faces of the respective vanes 28*a* to 28*d* are engagingly retained seal members 30 for rubbing contact with inner peripheral faces of the housing 6.

The lock mechanism 10 has a construction such that a lock pin 34 is inserted into an engagement hole (not shown) at a rotation position on the maximum delay angle side of the rotation member 3.

Figure 2:
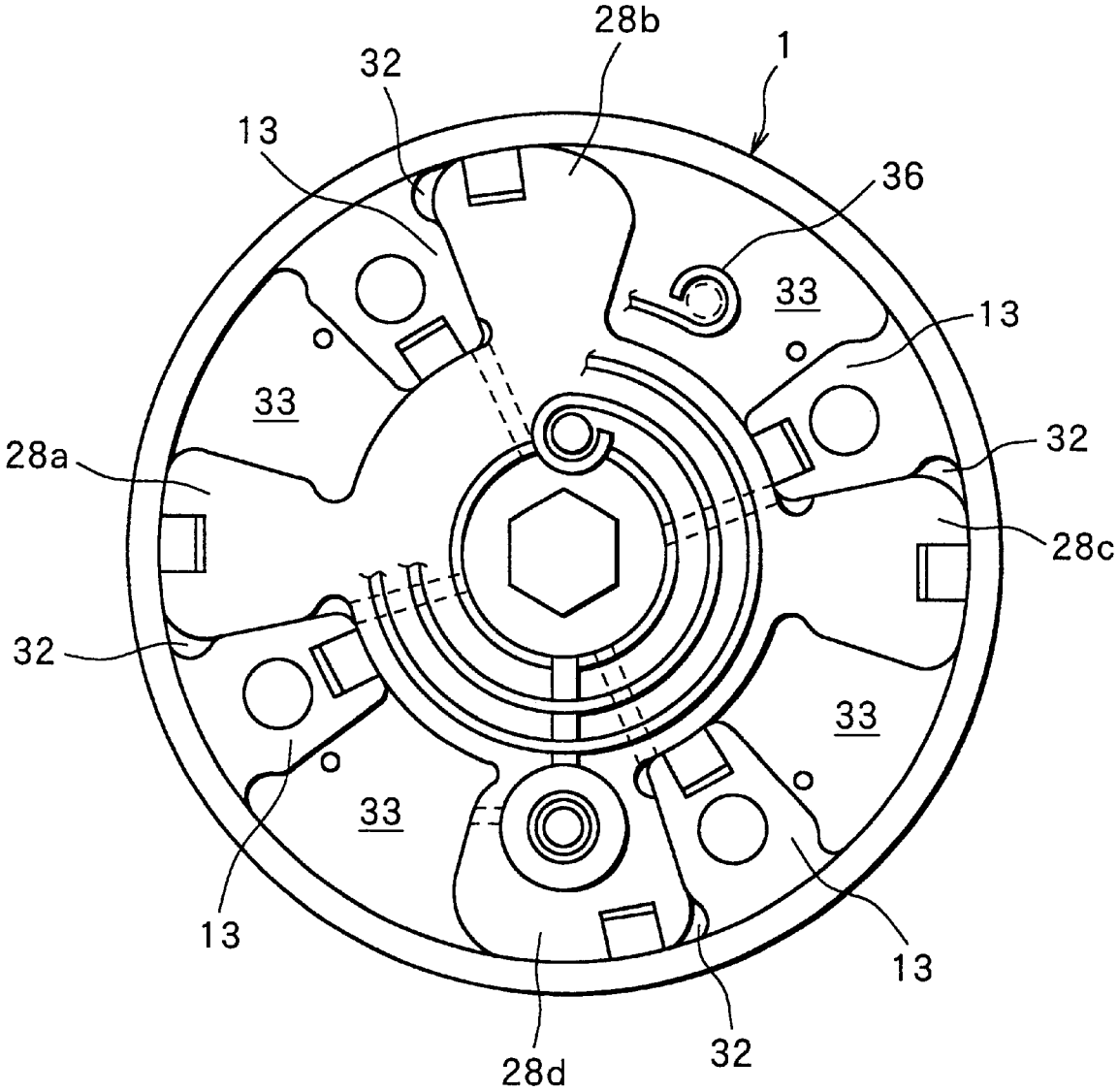
FIG. 2 is a sectional view showing a vane urging mechanism in the valve timing control apparatus.

Moreover, as shown in FIG. 2, the rotation member 3 (vanes 28*a* to 28*d*) has a construction such that one end thereof is secured to the front cover, and the other end is urged to the most delay angle position being an initial position by a spiral spring 36 serving as a resilient body, secured to the base 27 by a pin.

As the resilient body for urging the rotation member 3 (vanes 28*a* to 28*d*), an extension/compression coil spring, a torsion coil spring, a plate spring or the like may be used instead of the spiral spring 36.

The hydraulic circuit 4 has a dual system oil pressure passage, namely a first oil pressure passage 41 for supplying and discharging oil pressure with respect to the advance angle side hydraulic chambers 32, and a second oil pressure passage 42 for supplying and discharging oil pressure with respect to the delay angle side hydraulic chambers 33. To these two oil pressure passages 41 and 42 are connected a supply passage 43 and drain passages 44*a* and 44*b*, respectively, via an electromagnetic switching valve 45 for switching the passages. An engine driven oil pump 47 for pumping oil inside an oil pan 46 is provided in the supply passage 43, and the downstream ends of the drain passages 44*a* and 44*b* are communicated with the oil pan 46.

The first oil pressure passage 41 is formed substantially radially in the base 27 of the rotation member 3, and connected to four branching paths 41*d* communicating with each hydraulic chamber 32 on the advance angle side. The second oil pressure passage 42 is connected to four oil galleries 42*d* opening to each hydraulic chamber 33 on the delay angle side.

With the electromagnetic switching valve 45, an internal spool valve is arranged so as to control relative switching between the respective oil pressure passages 41 and 42, and the supply passage 43 and first and second drain passages 44*a* and 44*b*. The switching operation is effected by a control signal from a controller 48.

Figure 3:
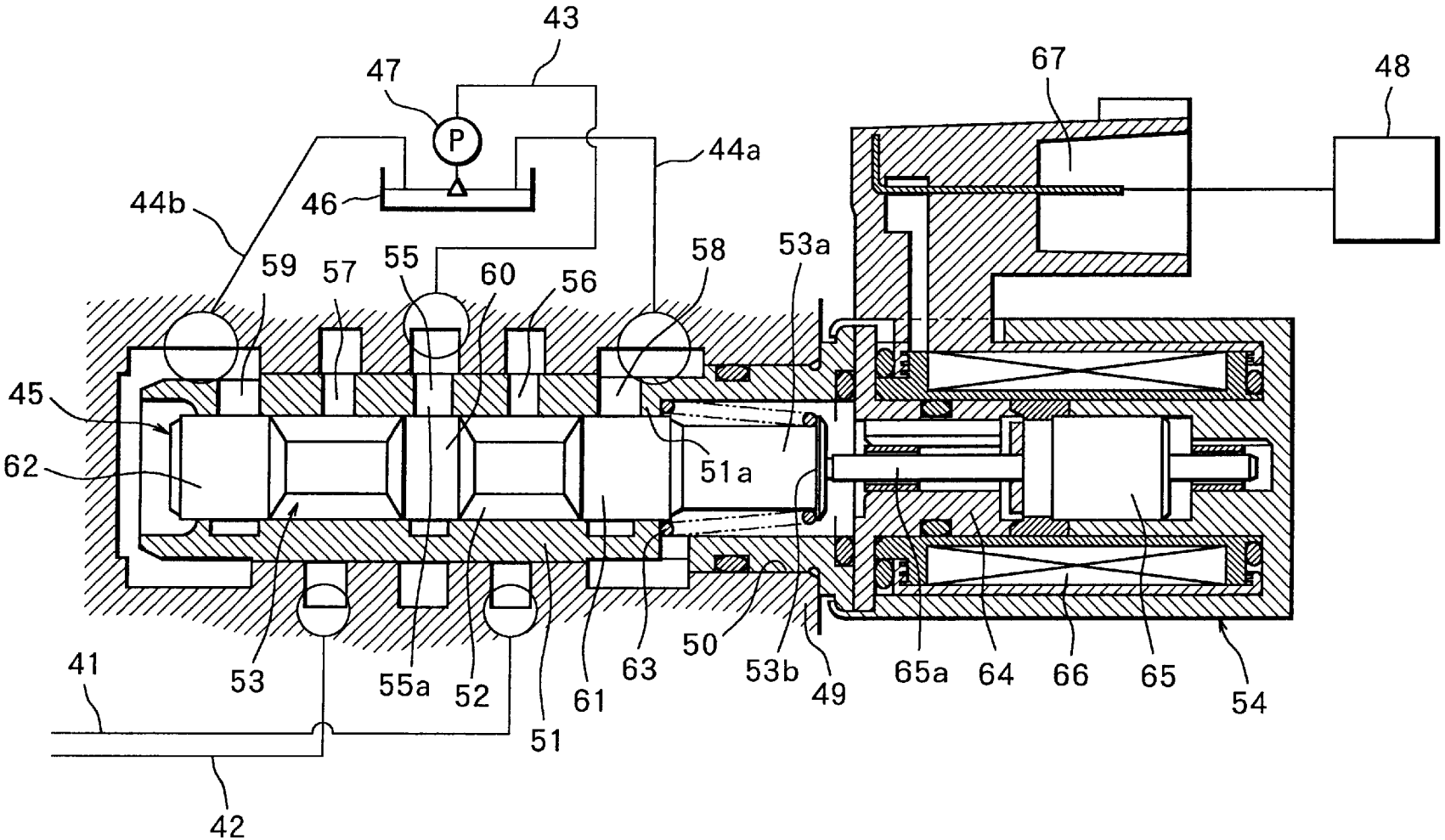
FIG. 3 is a longitudinal section showing an electromagnetic switching valve in the valve timing control apparatus.

More specifically, as shown in FIG. 3, the electromagnetic switching valve 45 comprises a cylindrical valve body 51 insertingly secured inside a retaining bore 50 of a cylinder block 49, a spool valve 53 slidably provided inside a valve bore 52 in the valve body 51 for switching the flow passages, and a proportional solenoid type electromagnetic actuator 54 for actuating the spool valve 53.

With the valve body 51, a supply port 55 is formed in a substantially central position of the peripheral wall, for communicating a downstream side end of the supply passage 43 with the valve bore 52, and a first port 56 and a second port 57 are respectively formed in opposite sides of the supply port 55, for communicating the other end portions of the first and second oil pressure passages 41 and 42 with the valve bore 52. Moreover, a third and fourth port 58 and 59 are formed in the opposite end portions of the peripheral wall, for communicating the two drain passages 44*a* and 44*b* with the valve bore 52.

The spool valve 53 has a substantially columnar shape first valve portion 60 on a central portion of a small diameter axial portion, for opening and closing the supply port 55, and has substantially columnar shape second and third valve portions 61 and 62 on opposite end portions, for opening and closing the third and fourth ports 58 and 59. Furthermore, the spool valve 53 is urged to the right in the figure, that is, in a direction such that the supply port 55 and the second oil pressure passage 42 are communicated by the first valve portion 60, by means of a conical shape valve spring 63 resiliently provided between an umbrella-shaped portion 53*b* on a rim of a front end spindle 53*a*, and a spring seat 51*a* on a front end inner peripheral wall of the valve bore 52.

The electromagnetic actuator 54 is provided with a core 64, a moving plunger 65, a coil 66, and a connector 67. A drive rod 65*a* is secured to a tip end of the moving plunger 65 for pressing against the umbrella-shaped portion 53*b* of the spool valve 53.

The controller 48 detects the current operating conditions (engine load, engine rotation speed) by means of signals from a rotation sensor 101 for detecting engine rotation speed and an air flow meter 102 for detecting intake air quantity, and detects the relative rotation position of the cam sprocket 1 and the cam shaft, that is to say, the rotation phase of the cam shaft with respect to the crank shaft, by means of signals from a crank angle sensor 103 and a cam sensor 104.

The controller 48 controls the energizing quantity for the electromagnetic actuator 54 based on a duty control signal superimposed with a dither signal.

For example, when a control signal of duty ratio 0% (off signal) is output from the controller 48 to the electromagnetic actuator 54, the spool valve 53 moves towards the maximum right direction in the figure, under the spring force of the valve spring 63. As a result, the first valve portion 60 opens an opening end 55*a* of the supply port 55 to communicate with the second port 57, and at the same time the second valve portion 61 opens an opening end of the third port 58, and the third valve portion 62 closes the fourth port 59. Therefore, the hydraulic fluid pumped from the oil pump 47 is supplied to the delay angle side hydraulic chambers 33 via the supply port 55, the valve bore 52, the second port 57, and the second oil pressure passage 42, and the hydraulic fluid inside the advance angle side hydraulic chambers 32 is discharged to inside the oil pan 46 from the first drain passage 44*a* via the first oil pressure passage 41, the first port 56, the valve bore 52, and the third port 58.

Consequently, the pressure inside the delay angle side hydraulic chambers 33 becomes a high pressure while the pressure inside the advance angle side hydraulic chambers 32 becomes a low pressure, and the rotation member 3 is rotated to the full to the delay angle side by means of the vanes 28*a* to 28*d*. The result of this is that the opening timing for the intake valves is delayed, and the overlap with the exhaust valves is thus reduced.

On the other hand, when a control signal of a duty ratio 100% (on signal) is output from the controller 48 to the electromagnetic actuator 54, the spool valve 53 slides fully to the left in the figure, against the spring force of the valve spring 63. As a result, the second valve portion 61 closes the third port 58 and at the same time the third valve portion 62 opens the fourth port 59, and the first valve portion 60 allows communication between the supply port 55 and the first port 56. Therefore, the hydraulic fluid is supplied to inside the advance angle side hydraulic chambers 32 via the supply port 55, the first port 56, and the first oil pressure passage 41, and the hydraulic fluid inside the delay angle side hydraulic chambers 33 is discharged to the oil pan 46 via the second oil pressure passage 42, the second port 57, the fourth port 59, and the second drain passage 44*b*, so that the delay angle side hydraulic chambers 33 become a low pressure.

Therefore, the rotation member 3 is rotated to the full to the advance angle side by means of the vanes 28*a* to 28*d*. Due to this, the opening timing for the intake valve is advanced (advance angle) and the overlap with the exhaust valve is thus increased.

When a control signal having a duty ratio of 50% is output from the controller 48 to the electromagnetic actuator 54, the spool valve 53 takes a position (neutral position) where the first valve portion 60 closes the supply port 55, the second valve portion 61 closes the third port 58, and the third valve portion 62 closes the fourth port 59.

Moreover, the controller 48 sets by proportional, integral and derivative (PID) control action, a feedback correction amount PIDDTY for making a relative rotation position (rotation phase) of the cam sprocket 1 and the cam shaft 2 detected based on a signal from the crank angle sensor 103 and the cam sensor 104, coincide with a target value (target advance angle value) for the relative rotation position (rotation phase) set corresponding to the operating conditions. The controller 48 then makes the result of adding a predetermined base duty ratio BASEDTY (for example, 50%) to the feedback correction amount PIDDTY a final duty ratio VTCDTY, and superimposes a dither signal on the control signal for the duty ratio VTCDTY and outputs this to the electromagnetic actuator 54.

Namely, in the case where it is necessary to change the relative rotation position (rotation phase) in the delay angle direction, the duty ratio is reduced by means of the feedback correction amount PIDDTY, so that the hydraulic fluid pumped from the oil pump 47 is supplied to the delay angle side hydraulic chambers 33, and at the same time the hydraulic fluid inside the advance angle side hydraulic chambers 32 is discharged to inside the oil pan 46. Conversely, in the case where it is necessary to change the relative rotation position (rotation phase) in the advance angle direction, the duty ratio is increased by means of the feedback correction amount PIDDTY, so that the hydraulic fluid is supplied to inside the advance angle side hydraulic chambers 32, and at the same time the hydraulic fluid inside the delay angle side hydraulic chambers 33 is discharged to the oil pan 46. Furthermore, in the case where the relative rotation position (rotation phase) is maintained in the current condition, the absolute value of the feedback correction amount PIDDTY decreases to thereby control so as to return to a duty ratio close to the base duty ratio.

The function of detecting the relative rotation position (rotation phase) of the cam sprocket 1 and the cam shaft 2 detected based on signals from the crank angle sensor 103 and the cam sensor 104 corresponds to a rotation phase detection means.

Figure 4:
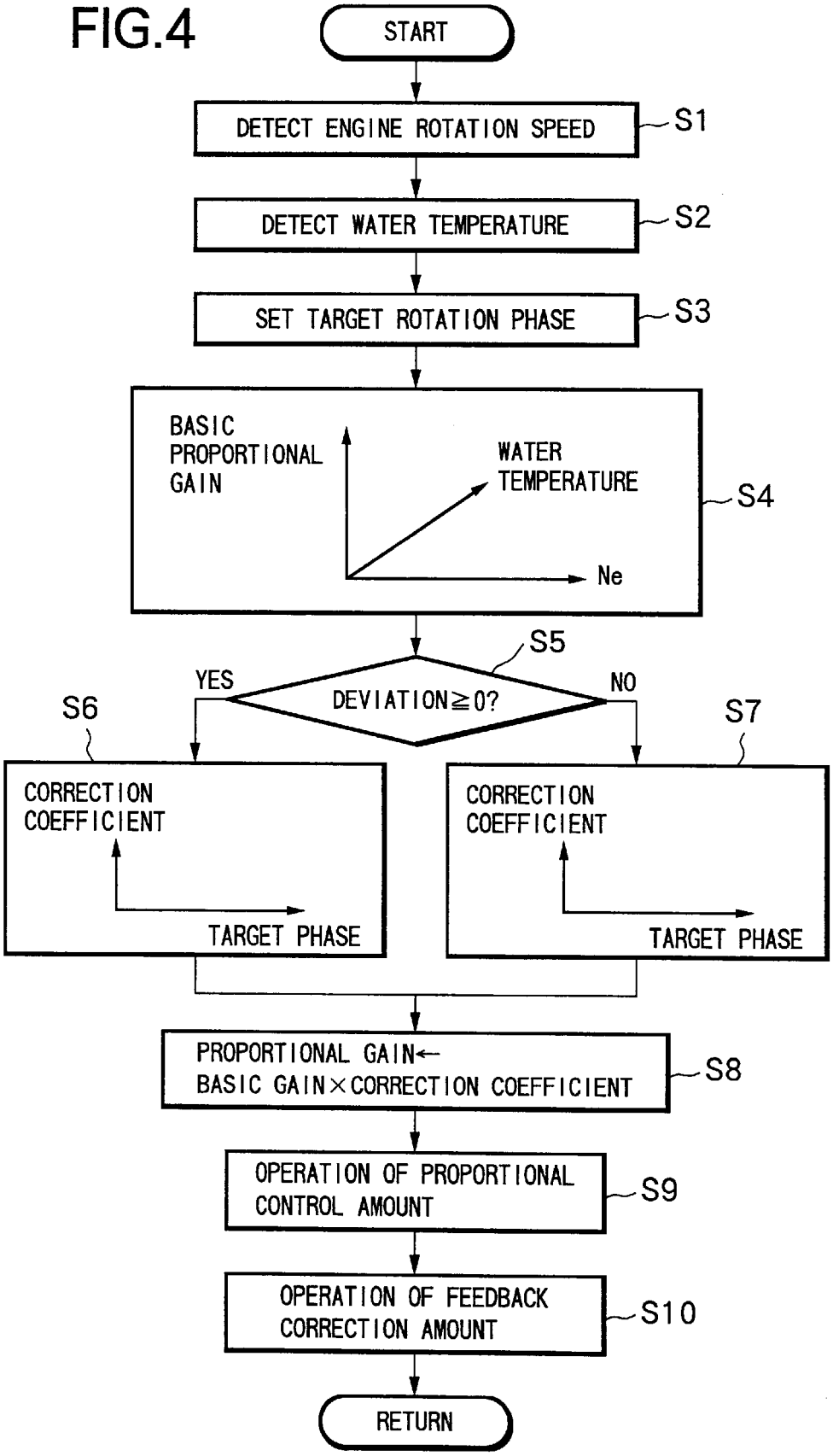
FIG. 4 is a flow chart showing a feedback control function in the valve timing control apparatus.

The setting control of the feedback correction amount PIDDTY by means of the controller 48, will now be described in accordance with a flow chart in FIG. 4.

In step S1, the engine rotation speed Ne is operated based on a detection signal from the rotation sensor 101.

In step S2, the cooling water temperature Tw of the engine is detected based on a detection signal from a water temperature sensor 105.

In step S3, a target value of the rotation phase is set according to, for example, the engine load or the engine rotation speed Ne.

In step S4, a basic value of the gain (proportional gain) in the proportional control operation of the feedback control is set according to the cooling water temperature Tw and the engine rotation speed Ne.

The cooling water temperature Tw is used as a parameter that represents the temperature of the hydraulic fluid. The oil pump 47 is driven by the engine, and the rotation speed of the pump is changed in proportion to the engine rotation speed Ne. Therefore, the engine rotation speed Ne is used as a parameter that represents the hydraulic pressure and, hence, the basic proportional gain is set to meet the response characteristic that differs depending on the temperature (viscosity) of the hydraulic fluid and the hydraulic pressure.

Accordingly, step S1 corresponds to the pressure detecting means, and step S2 corresponds to the oil temperature detecting means. Further, step S3 corresponds to the target value operation means, and step S4 corresponds to basic gain operation means.

In step S5, it is judged whether a deviation between the target value and the real rotation phase is equal to or more than 0 or not, in other words, whether the rotation phase needs to be corrected toward the advance angle side or toward the delay angle side. Step S5 corresponds to the control direction judging means.

When the deviation is equal to or more than 0 and the rotation phase needs to be corrected toward the advance angle side, the routine proceeds to step S6. On the contrary, when the deviation is smaller than 0 (minus) and the rotation phase needs to be corrected toward the delay angle side, the routine proceeds to step S7.

In steps S6 and S7, reference is made to tables previously storing the correction coefficients of the basic proportional gains according to the target rotation phases, to retrieve a correction coefficient corresponding to the target rotation phase at that moment.

The table to be referred to in step S6 represents characteristics corresponding to a change in the urging force of the spiral spring 36 of when the rotation phase is changed toward the advance angle side, and the table to be referred to in step S7 represents characteristics corresponding to a change in the urging force of the spiral spring 36 of when the rotation phase is changed toward the delay angle side.

It is therefore possible to change over the proportional gain depending on a difference in the change of the urging force of the spiral spring 36 caused by the direction in which the rotation phase is changed and also to change over the proportional gain depending on a difference in the urging force caused by the target rotation phase.

Steps S6 and S7 correspond to the correction coefficient operation means.

In step S8, the basic proportional gain is correctingly set by the correction coefficient retrieved in step S6 or step S7 to determine a final proportional gain. Step S8 corresponds to the feedback gain operation means.

In step S9, the proportional control amount (feedback correction value) is set by the proportional operation based on the deviation and the proportional gain. Step S9 corresponds to the feedback correction value operation means.

In step S10, the feedback correction amount PIDDTY is determined based on the proportional control amount and the integration control amount/derivative control amount to be separately operated.

The thus set feedback correction amount PIDDTY is added to the base duty ratio BASEDTY to determine a final duty ratio VTCDTY, and the control signal of this duty ratio VTCDTY is output to the electromagnetic actuator 54. The function of outputting the control signal of this duty ratio VTCDTY to the electromagnetic actuator 54 corresponds to the feedback control means.

Here, the above construction is described as being for controlling the valve timing of the intake valve, but the construction may be for controlling the valve timing of the exhaust valve. In this case, the construction may be such that when a control signal having a duty ratio of 100% (on signal) is output to the electromagnetic actuator 54, the timing is controlled so as to be delayed (the overlap quantity is maximum), and when a control signal having a duty ratio of 0% (off signal) is output to the electromagnetic actuator 54, the timing is controlled so as to be advanced (the overlap quantity is minimum). Moreover, the vanes (rotation body 3) may be urged to the advance angle side by the spiral spring 36.

What I claim is:

1. A vane type variable valve timing control apparatus for changing a rotation phase of a cam shaft relative to a cam sprocket comprising:

a vane secured to the cam shaft;

a housing provided integral with the cam sprocket, and housing said vane so as to be relatively rotatable thereto to thereby form an advance angle side hydraulic chamber and a delay angle side hydraulic chamber on rotation direction front and rear sides of said vane;

a valve for controlling supply/discharge of oil with respect to said advance angle side hydraulic chamber and said delay angle side hydraulic chamber; and a resilient member for urging said vane toward an initial position, wherein a gain in a feedback control for bringing said rotation phase into agreement with a target is changed over according to a control condition.

2. A vane type variable valve timing control apparatus according to claim 1, wherein said control condition is a target rotation phase.

3. A vane type variable valve timing control apparatus according to claim 1, wherein said control condition is a direction in which the rotation phase is changed.

4. A vane type variable valve timing control apparatus according to claim 1, wherein said control condition is a target rotation phase and a direction in which the rotation phase is changed.

5. A vane type variable valve timing control apparatus for changing a rotation phase of a cam shaft relative to a cam sprocket comprising:

a vane secured to the cam shaft;

a housing provided integral with the cam sprocket, and housing said vane so as to be relatively rotatable thereto to thereby form an advance angle side hydraulic chamber and a delay angle side hydraulic chamber on rotation direction front and rear sides of said vane;

a valve for controlling supply/discharge of oil with respect to said advance angle side hydraulic chamber and said delay angle side hydraulic chamber;

a resilient member for urging said vane toward an initial position;

basic gain operation means for operating a basic gain in a feedback control of said valve;

target value operation means for operating a target value of a rotation phase between said cam shaft and said cam sprocket;

rotation phase detecting means for detecting said rotation phase;

control direction judging means for judging whether a direction in which the rotation phase is changed for bringing said rotation phase close to said target value is a delay angle direction or is an advance angle direction;

correction coefficient operation means for operating a correction coefficient for correcting said basic gain based on the result of judging the direction in which the rotation phase is changed and the target value of said rotation phase;

feedback gain operation means for operating a feedback gain based on said basic gain and said correction coefficient;

feedback correction value operation means for operating a feedback correction value based on said feedback gain and a deviation between the target value of said rotation phase and the rotation phase; and feedback control means for controlling said valve based on said feedback correction value.

6. A vane type variable valve timing control apparatus according to claim 5, wherein said basic gain operation means comprises:

pressure detecting means for detecting a pressure of hydraulic fluid;

oil temperature detecting means for detecting a temperature of hydraulic fluid; and operation means for operating a basic gain in a feedback control of said valve based on said detected pressure and temperature of hydraulic fluid.

7. A method of controlling a vane type variable valve timing control apparatus for changing a rotation phase of a cam shaft relative to a cam sprocket comprising:

a vane secured to the cam shaft;

a housing provided integral with the cam sprocket, and housing said vane so as to be relatively rotatable thereto to thereby form an advance angle side hydraulic chamber and a delay angle side hydraulic chamber on rotation direction front and rear sides of said vane;

a valve for controlling supply/discharge of oil with respect to said advance angle side hydraulic chamber and said delay angle side hydraulic chamber; and a resilient member for urging said vane toward an initial position, said method comprising the step of:

changing over a gain in a feedback control for bringing said rotation phase into agreement with a target according to a control condition.

8. A method of controlling a vane type variable valve timing control apparatus according to claim 7, wherein said step of changing over a gain changes over said gain according to a target rotation phase, as said control condition.

9. A method of controlling a vane type variable valve timing control apparatus according to claim 7, wherein said step of changing over a gain changes over said gain according to a direction in which the rotation phase is changed, as said control condition.

10. A method of controlling a vane type variable valve timing control apparatus according to claim 7, wherein said step of changing over a gain changes over said gain according to a target rotation phase and a direction in which the rotation phase is changed, as said control condition.

* * * * *